United States Patent [19]

Valley

[11] Patent Number: 4,763,693

[45] Date of Patent: Aug. 16, 1988

[54] FAUCET WITH IMPROVED SWIVEL SPOUT

[76] Inventor: Harold J. Valley, 23462 Coso, Mission Viejo, Calif. 92692

[21] Appl. No.: 22,026

[22] Filed: Mar. 5, 1987

[51] Int. Cl.[4] ..... E03C 1/04

[52] U.S. Cl. ..... 137/801; 137/606; 137/615; 285/275; 285/282; 285/355

[58] Field of Search ..... 137/606, 615, 801; 285/90, 275, 278, 282, 355

[56] References Cited

U.S. PATENT DOCUMENTS

| | | | |
|---|---|---|---|
| 1,583,173 | 5/1926 | Price et al. | 137/615 |
| 1,734,506 | 11/1929 | Walter | 285/355 X |
| 2,389,599 | 11/1945 | Delany | 137/606 |
| 2,427,124 | 9/1947 | Dawson | 137/606 |
| 4,592,388 | 6/1986 | Wilcox | 137/801 X |

*Primary Examiner*—Gerald A. Michalsky

*Attorney, Agent, or Firm*—Cahill, Sutton & Thomas

[57] ABSTRACT

A swivel spout sub-assembly is disclosed for use on water faucets with the swivel spout sub-assembly being of simplified configuration to provide facile assembly and disasembly thereof. The swivel spout sub-assembly includes a water output nipple on the faucet and a swivel spout structure including a shroud body having an axial bore in which the nipple is coaxially disposed. The shroud body and the nipple are especially configured to interact with each other to provide a means for assembling the spout structure on the nipple, allow the spout structure to be moved in a swivel motion about the nipple and prevent unintentional removal of the spout structure from the nipple.

12 Claims, 1 Drawing Sheet

FIG. 1
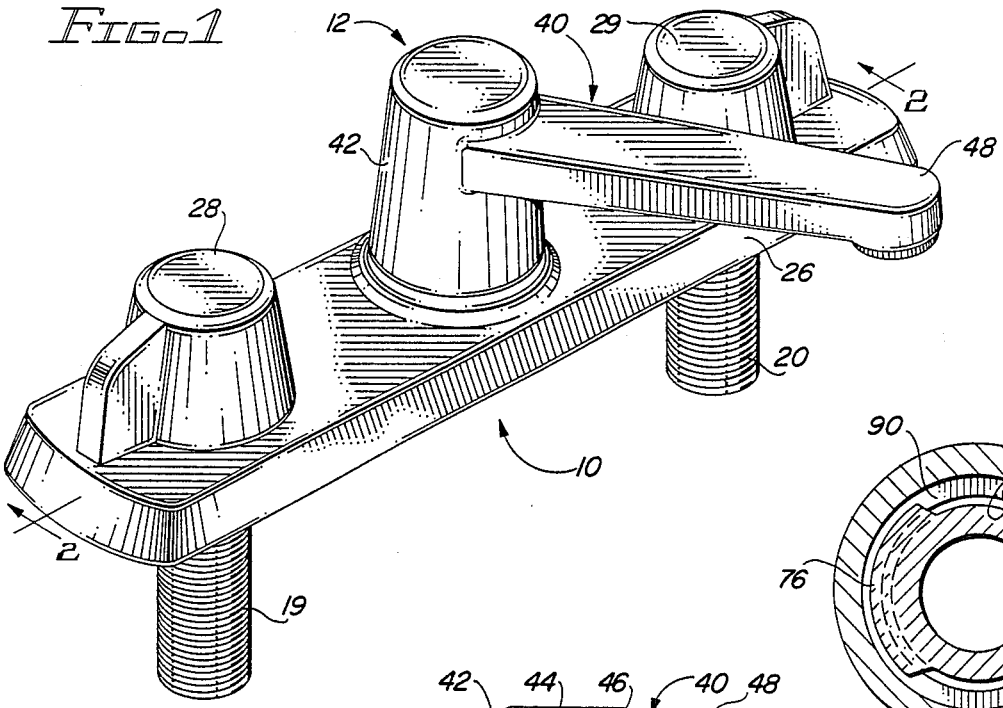
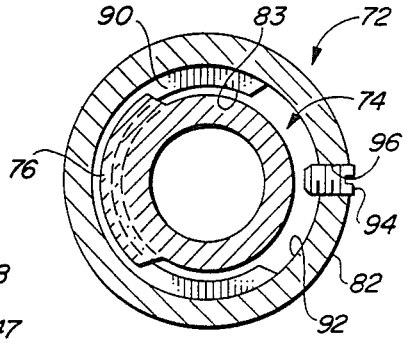
FIG. 5
FIG. 2
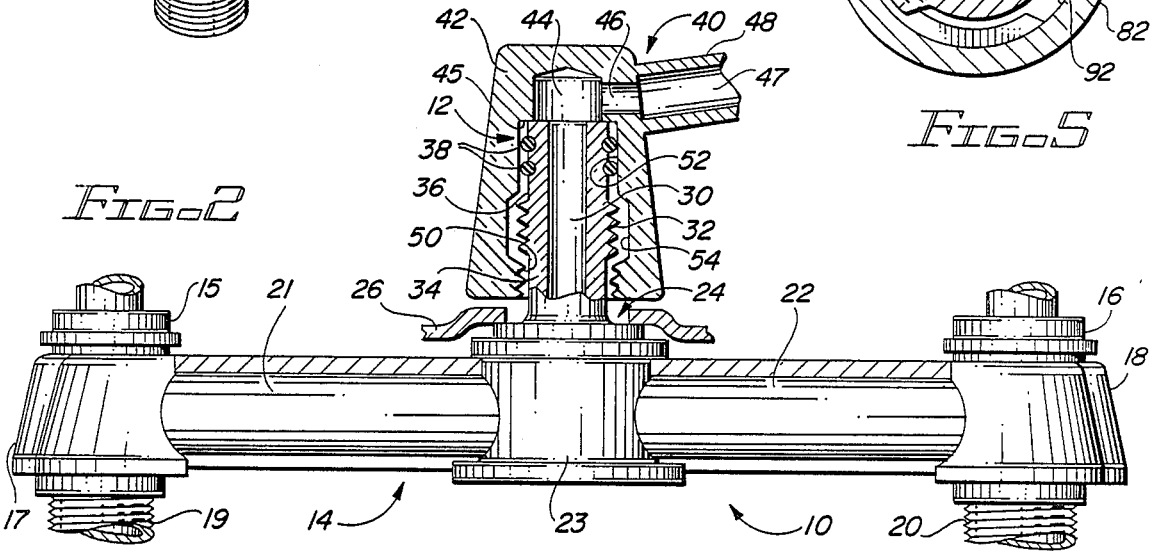
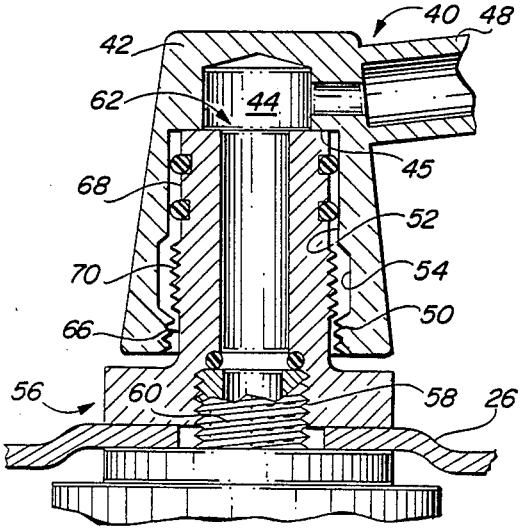
FIG. 3
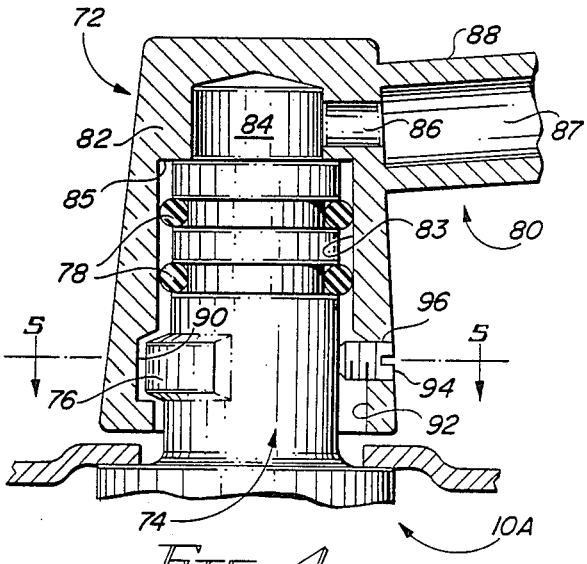
FIG. 4

FAUCET WITH IMPROVED SWIVEL SPOUT

BACKGROUND OF THE INVENTION

1. Field of the Invention

This invention relates in general to water faucets and more particularly to an improved swivel spout structure for use with water faucets.

2. Description of the Prior Art

An important aspect of many modern water faucets is a movable spout which allows the spout to be swiveled into various positions over a sink or to be rotated completely out of the way when it is not being used. Swivel spout sub-assemblies are in common usage on two basic types of water faucets, namely on single water line faucets and those which are commonly referred to as mixing faucets due to their being connected to both a hot water line and a cold water line. Even though single water line faucets are considerably simpler than mixing faucets, the swivel spouts of those faucets are generally similar to each other.

Some prior art attempts have been made in mixing faucet structures to incorporate various other functions in with the swivel spout mechanism such as water temperature regulating structures, flow rate regulating structures, and the like. Such mixing faucet structures are relatively costly and of complex configuration and are not related to the scope and objectives of the improvements of the present invention.

Generally speaking, a swivel spout sub-assembly, other than the complex multi-function structures mentioned above, will include a spout, a faucet body which is configured to accept the spout and separate mounting hardware for demountably interconnecting the faucet body and the spout. Although must swivel spout sub-assemblies are reliable and function quite well, they need to disassembled from time to time for replacing worn or damaged "O"-rings or whatever type of sealing gaskets are used in the particular sub-assembly. In addition to the costs associated with these multi-component prior art swivel spout assemblies, disassembly and reassembly difficulties exist.

Some prior art swivel spout sub-assemblies employ an exposed threaded nut for attachment of the spout to an externally threaded boss, or nipple, of the faucet body. Whenever disassembly is required, a wrench must be used on the threaded nut. Due to corrosion and/or mineral deposition, loosening and removal of the mounting nut can be difficult and almost invariably, the decorative and corrosion inhibiting plating of the mounting nut will be damaged. When plating damage occurs, the nut should be replaced not only for appearance sake, but to prevent rapid corrosive destruction. Due to corrosion problems several attempts have been made to use plastic components. However, such components can be easily damaged, split or otherwise destroyed whenever a wrench needs to be used for disassembly. Typical prior art examples of this type of swivel mounting structure can be seen in U.S. Pat. No. 3,998,240 which issued on Dec. 21, 1976, to J. P. Liautaud, and in U.S. Pat. No. 4,484,600 of D. W. Peterson et al which issued on Nov. 27, 1984.

Whenever a more decorative appearance is desired, another basic type of swivel spout configuration is used instead of the above described exposed mounting nut. In this second prior art type of swivel spout mounting arrangement an especially configured connector is used with such a connector be sometimes referred to as a shroud ring. A shroud ring is provided with a smooth and decorative exposed portion which is considered by many to be more aesthetically appealing than an exposed threaded nut. The shroud ring is also provided with a hidden portion which is threadingly attached to the faucet body such as by being located beneath the decorative shell of the faucet body. In that the exposed decorative portion of a shroud ring is smooth, a conventional wrench cannot be used and a pipe wrench will quickly destroy that portion of the shroud ring. Therefore, shroud rings require some sort of special tool for removal and installation with such special tools be dependent on the particular shroud ring configuration. One example of this prior art latter type of swivel spout structure may be seen in U.S. Pat. No. 3,870,075 of E. R. Percival et al which issued on Mar. 11, 1975.

Due to the lack of the required special tool and the well known possibility of component damage, many people are hesitant to make what would otherwise be a simple repair. As a result, many faucets are left with leaking swivel spout sub-assemblies.

Therefore, a need exists for a new and improved swivel spout sub-assembly for use on water faucets which overcomes some of the problems and shortcomings of the prior art.

SUMMARY OF THE INVENTION

In accordance with the present invention, a new and improved swivel spout assembly is disclosed for use on either a single water line faucet or on a mixing water faucet with the swivel spout assembly being of simplified configuration which facilitates assembly and disassembly.

In the preferred embodiment, a shroud body is formed integral with a spout and the shroud body defines a bore having its upper end in communication with the spout and having its lower end open. The shroud body is configured so that its bore is circumscribed by a threaded portion, an annular groove and a sealing surface at separate predetermined locations along the length thereof. The shroud body interacts with an especially configured nipple provided on the faucet body for demountably attaching the shroud body, and thus the entire spout structure, to the faucet body. The special nipple is configured to provide a threaded portion, an annular relief portion and a seal carrying portion at separate predetermined locations along its length. The special configurations of the bore of the shroud body and the periphery of the nipple allows the shroud body to be threadingly moved onto the nipple with such movement continuing until the threads move out of meshing engagement with each other. When this occurs, the threads of the nipple will be located in the annular groove of the shroud body and the threads of the shroud body will be located in the annular relief of the nipple, thus allowing the entire spout structure to be moved in a swiveling motion. The relative positions of the threads in this fully mounted position will inhibit linear axial movement of the shroud body in a disassembly direction due the threads being in an axially juxtaposed position so as to interfere with each other in the event of linear axial movement. Whenever disassembly is needed, exertion of an upwardly directed pulling force combined with rotation in the appropriate direction will bring the threaded portions of the shroud body and the nipple back into meshing engagement with each other and continued rotation in that same direction will disconnect the spout structure from the faucet body.

In the above described preferred embodiment of the present invention, it will be appreciated that the swivel spout sub-assembly is of simplified configuration in that no separate attaching hardware is needed and no special or conventional tools are needed for assembly or disassembly.

In a second embodiment, the special nipple of the faucet body is formed with a laterally extending tab or lug in addition to the seal carrying means formed thereon. The shroud body, which is integrally formed with the spout as in the first embodiment, defines a downwardly opening bore. The shroud body is configured to provide an annular groove which opens into the bore of the body with a depending channel or slot which extends from the groove to the open mouth of the bore of the shroud body. The lug of the nipple and the depending slot of the shroud body are configured so that the lug will move through slot into the annular groove of the shroud body when the shroud shroud body is moved in a linear axial direction onto the nipple. When the lug is located in the annular groove, the spout structure is capable of being moved in the desired swiveling motion. To prevent undesired axial removal, a set screw is provided on the shroud body so as to protrude in the annular groove at a location proximate the depending slot. The set screw acts like a stop to prevent the shroud body from being rotated into registered alignment with the slot when disassembly is needed, the set screw is backed out of the annular groove so that the shroud body can be rotated to bring the slot into registered alignment below the lug of the fitting. Then, a simple lifting movement of the shroud body will move the slot of the shroud body past the lug of the nipple thus completing the disassembly.

Accordingly, it is an object of the present invention to provide a new and improved swivel spout sub-assembly for use on water faucets.

Another object of the present invention is to provide a new and improved swivel spout sub-assembly for use on water faucets with the swivel spout structure being of simplified configuration which allows assembly and disassembly without any tools in a first embodiment and requires the use of a single conventional tool in a second embodiment.

Another object of the present invention is to provide a new and improved swivel spout sub-assembly of the above described character wherein a water spout is provided with an integral shroud body for mounting on a nipple of a faucet body with the shroud body and the nipple being of special configuration to provide a mounting means for assembly of the shroud body on the nipple and forming a demountable interference for inhibiting disassembly, and also configured to provide relief means which allows the spout structure to be swiveled about the longitudinal axis of the nipple.

The foregoing and other objects of the present invention as well as the invention itself, may be more fully understood from the following description when read in conjunction with the accompanying drawings.

BRIEF DESCRIPTION OF THE DRAWINGS

FIG. 1 is a perspective view of a typical water faucet assembly including the swivel spout sub-assembly of the present invention.

FIG. 2 is an enlarged fragmentary sectional view taken along the line 2—2 of FIG. 1 and showing a preferred embodiment of the present invention.

FIG. 3 is a view similar to FIG. 2 and showing a modification of the embodiment of FIG. 2.

FIG. 4 is a sectional view similar to FIGS. 2 and 3 but showing a second embodiment of the present invention.

FIG. 5 is a sectional view taken along the line 5—5 of FIG. 4.

DESCRIPTION OF THE PREFERRED EMBODIMENT

Referring more particularly to the drawings, FIGS. 1 and 2 show a typical water faucet assembly of the type commonly referred to as a mixing faucet and which is indicated generally herein by the reference numeral 10. As will hereinafter be described in detail, the swivel spout sub-assembly of the present invention which is indicated in its entirety by the reference numeral 12, is provided on the faucet assembly 10.

The particular faucet assembly 10 which is shown and described herein is not intended as a limitation of the present invention but is included herein for completeness of the disclosure. It will be appreciated by those skilled in the art that the swivel spout sub-assembly 12 may be formed on other than the illustrated mixing faucet 10, such as on a well known single water line faucet (not shown).

The mixing faucet assembly 10 includes the usual manifold structure 14 having conventional on-off valves 15 and 16 mounted in its opposite ends 17 and 18 respectively, with those valves be connectable by means of threaded tubular pipes 19 and 20 to separate hot and cold water conduits (not shown). Water admitted to the manifold structure 14 by the on-off valves 15 and 16 is conducted by tubular pipes 21 and 22 to a centrally located mixing chamber portion 23 of the manifold and will exit the mixing chamber 23 via an upstanding nipple 24. As is customary in mixing faucets of this type, the manifold structure 14 is mounted on a suitable sink (not shown) and is concealed below a decorative cover 26, and conventional handles 28 and 29 are coupled to the on-off valves 15 and 16 for manual operation thereof.

In accordance with the present invention, the nipple 24 of the otherwise conventional faucet assembly 10, is of special configuration. The nipple 24 defines an axial bore 30 and is provided with an externally threaded portion 32 between an annular relief portion 34 at its proximal end and an annular seal carrying portion 36 on its distal end. The seal carrying portion 36 of the nipple 24 is provided with an axially spaced apart pair of annular grooves for carrying conventional O-ring gaskets 38 or any functional equivalent of such gaskets.

Further in accordance with the present invention an especially configured spout structure 40 is provided for demountable mounting on the faucet assembly 10. The special spout structure includes a shroud body 42 defining an axial bore which opens downwardly. The shroud body 42 defines a reduced diameter upper bore portion 44 which forms a downwardly facing shoulder 45 with the reduced diameter bore portion 44 being closed on its upper end and having a laterally extending passage 46. The laterally extending passage 46 opens into the bore 47 of a spout 48 of any desired configuration which is preferably formed integrally with the shroud body 42 such as by casting, welding or the like.

The shroud body is especially configured so that its axial bore is defined by a threaded portion 50 at the downwardly open mouth of the bore, a seal bearing surface 52 at its upper end immediately below the shoulder 45 and an annular groove 54 between the threaded portion 50 and the seal bearing surface 52. The special configurations of the shroud body 42 and the nipple 24 provide an interacting relationship for simplified assembly and disassembly of the swivel spout structure 40 as will now be described.

Mounting of the swivel spout structure 40 on the nipple 24 of the faucet assembly 10 is accomplished by axially moving the shroud body onto the nipple 24 until the threaded portion 50 of the shroud body 42 comes into engagement with the threaded portion 32 of the nipple 24. Rotation of the shroud body 42 is then accomplished to being the threaded portion 50 of the shroud body 42 into meshing engagement with the threaded portion 32 of the nipple 24. When this meshing engagement is accomplished, continued rotation of the shroud in the appropriate direction of rotation, such as clockwise for right hand threads, will move the shroud body downwardly on the nipple 24 and ultimately move the threaded portion 50 downwardly past the threaded portion 32 of the nipple 24, that is out of meshing engagement therewith. When fully mounted in this manner, the threaded portion 50 of the shroud body will be located in the annular relief portion 34 of the nipple 24, and the threaded portion 32 of the nipple 24 will be located in the annular groove 54 of the shroud body.

As shown, the major and minor diameters of the threaded portions 32 and 50 of the nipple and shroud body and the diameters of the relief portion 34 of the nipple and the annular groove 54 of the shroud body are such that when the shroud body is in the fully mounted position, there is no engagement of between those various portions. The only engagement between the shroud body 42 and the nipple 24 is that provided by the O-ring seals 38. Therefore, the shroud body 42, and thus the entire spout structure 40 is free for swivel movement about the longitudinal axis of the nipple.

When the shroud body 42 is fully mounted on the nipple 24, axial movement of the shroud body 42 toward the faucet structure 10 is prevented by the distal end of the nipple 24 being in bearing engagement with the shoulder 45 provided in the bore of the shroud body 42. The juxtaposed positions of the threaded portion 50 of the shroud body 42 and the threaded portion 32 of the nipple will prevent linear axial movement in a disassembly direction in that any movement of the shroud body 42 away from the faucet structure 10 will bring the threads 50 of the shroud body 42 into a bearing interfering relationship with the threads 32 of the nipple 24.

Whenever disassembly of the spout structure 40 is required, such as for replacement of the O-ring gaskets 38, the application of an upwardly applied pulling force and simultaneous rotation of the shroud body 42 in the appropriate direction, such as counterclockwise for right hand threads, will bring the threads 50 of the shroud body back into meshing engagement with the threads 32 of the nipple 24. Continued rotation in that same direction of the shroud body 42 will, of course, result in disassembly of the spout structure 40 from the faucet assembly 10.

Therefore, the threaded portions 32 and 50 of the nipple and shroud body 24 and 42 form what may be described as cooperating elements of a demountable mounting means for assembly of the spout structure 40 on the nipple 24 of the faucet 10 in a fully mounted position. When fully mounted, those same threaded portions provide an interference means which inhibits linear axial disassembly of the shroud body 42 from the nipple. Also, when in the fully mounted position, the annular relief portion 24 of the nipple 24 and the annular groove 54 of the shroud body 42 form what may be described as a relief means for allowing swivel movement of the spout structure 40 about the longitudinal axis of the nipple 24.

As shown in FIG. 2, the special nipple 24 is an integral part of the faucet structure 40 and can be made as such by casting, welding or the like. As an alternative, the special nipple configuration may be in the form of an adapter fitting 56 which is shown in FIG. 3. In this modification of the preferred embodiment, the adapter fitting 56 is provided with an internally threaded counterbore 58 for mounting on a conventional nipple 60 of the faucet assembly. Like the hereinbefore described nipple 24, the adapter fitting is provided with a nipple portion 62 which extends axially and upwardly from a suitable base 64. The nipple portion has the annular relief area 66, seal carrying portion 68 with threaded portion 70 therebetween.

The previously described spout structure 40 is mountable on the adapter fitting 56 and interacts therewith in the same manner.

Referring now to FIGS. 4 and 5 wherein a second embodiment of the swivel spout sub-assembly is shown and is identified in its entirety by the reference numeral 72. The faucet structure 10A may be identical to the hereinbefore described faucet 10 with the exception of the special nipple 74. The nipple 74 is of generally cylindrical configuration with a protruding tab, or lug, 76 extending therefrom proximate it's proximal end. The distal end of the nipple is configured to hold a pair of O-ring gaskets 78 or a functional equivalent thereof. The nipple 74 may be an integral part of the faucet or may be a separate fitting (not shown) as hereinbefore described.

The swivel spout sub-assembly 72 also includes an especially configured spout structure 80 for demountable mounting on the faucet structure 10A. The spout structure 80 includes a shroud body 82 defining an axial bore 83 which opens downwardly and has a reduced diameter upper bore portion 84 to provide a downwardly facing shoulder 85. The reduced diameter bore portion 84 is closed on it's upper end and has a laterally extending passage 86 which is in communication with the bore 87 of a spout 88 which is preferably integral with the shroud body. The shroud body 82 is configured to define an annular groove 90 which opens into the axial bore 83 in upwardly spaced proximity to the open mouth of the bore. Also, a slot 92 is formed in the shroud body 82 so as to depend from an intersecting relationship with the annular groove 90 to the open mouth, or bottom, of the shroud body 82.

As seen in FIG. 5, the laterally extending lug 76 is of arcuate configuration with it being preferred that the arcuate length of the lug 76 being approximately equal to one quadrant of a circle. The slot 92 of the shroud body 82 is also of arcuate configuration with the length of the arc being approximately equal to or slightly greater than the arcuate length, or circular segment, of the lug.

Assembly of the swivel spout structure 72 is accomplished by vertically aligning the shroud body 82 so that the slot 92 thereof is above the lug 76 of the nipple 74, and moving the shroud body axially onto the nipple 74.

Such movement of the shroud body will cause the slot 92 thereof to move downwardly over the lug 76 of the nipple 74 until the lug is located in the intersection of the annular groove 90 and the slot 92 of the shroud body. Rotation of the shroud body through approximately 180° will then place the slot 92 out of alignment with the lug 76, i.e. into the position shown in FIG. 5. When the shroud body 82 has been assembled on the nipple 74 in the manner described, a stop screw 94 is threadingly moved inwardly in an internally threaded bore 96 formed in the sidewall of the shroud body. The bore 96 is located so that the stop screw 94 will protrude into the arcuate groove 90 of the shroud body immediately above the depending slot 92 thereof. Thus, the stop screw 94 will prevent rotation of the shroud body 82 to the extent that it cannot be rotated back into it's above described assembly position as long as the stop screen 94 is in the inwardly protruding position shown. Thus, the swivel spout structure 80 is free to swivel about the longitudinal axis of the nipple 74 through almost a full circle, but is prevented from being moved into a position wherein the slot 92 of the shroud body 82 is in vertical alignment with the lug 76 of the nipple 74.

Therefore, the protruding lug 76 of the nipple 74 and the depending slot 92 of the shroud body 82 form what may be described as cooperating elements of a demountable mounting means for assembly of the spout structure 80 on the nipple 74 of the faucet 10A. When fully mounted, the stop screw 94 and the lug 76 being in the groove 90 provides an interference means which prevents unintentional disassembly of the swivel spout subassembly 72. And, the annular groove 90 which allows the shroud body 84 to be rotatably moved, within the above described limits, relative to the lug 76, forms what may be defined as a relief means for allowing swivel movement of the swivel spout subassembly 72.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A water faucet with swivel spout comprising:

(a) a faucet for receiving water from at least one source;

(b) a nipple on said faucet and extending therefrom and having proximal and distal ends, said nipple defining a bore for the output of water from said faucet;

(c) a swivel spout structure for receiving water from said nipple and directing it to a point of delivery, said spout structure including a shroud body defining an axial bore in which said nipple is coaxially disposed, said shroud body defining a closed and an open end of its axial bore;

(d) said shroud body having internal threads circumscribing a portion of the axial bore defined thereby, said threads being limited to the portion which is proximate the open end of the axial bore of said shroud body;

(e) said shroud body having an annular groove which circumscribes a portion of the axial bore defined thereby with said annular groove being axially juxtaposed relative to the threaded portion of said shroud body; and (f) said nipple having an externally threaded portion intermediate its distal and proximate ends and having an annular relief portion between its threaded portion and the proximal end thereof;

whereby assembly of said swivel spout structure on said nipple is accomplished by moving the threads of said shroud body into meshing engagement with the threads of said nipple and rotating said spout structure until the threads of said shroud body and said nipple move out of meshing engagement with each other to place the threads of said nipple in the annular groove of said shroud body and to place the threads of said shroud body in the annular relief area of said nipple to allow swivel movement of said spout structure with the out of meshing engagement of said threads of said shroud body and said nipple preventing the unintentional removal of said spout structure.

2. A water faucet as claimed in claim 1, wherein said swivel spout structure further comprises:

(a) a spout extending from said shroud body and defining a water delivery bore; and (b) said shroud body having a passage extending between the closed end of the axial bore defined thereby and the water delivery bore of said spout.

3. A water faucet as claimed in claim 2, wherein said spout and said shroud body of said swivel spout structure are formed as a unitary structure.

4. A water faucet as claimed in claim 1, and further comprising, said shroud body of said swivel spout structure being configured to define an axially aligned reduced diameter bore portion at the closed end of the axial bore defined thereby to form a shoulder in the axial bore which in abutting engagement with the distal end of said nipple.

5. A water faucet as claimed in claim 1, wherein said nipple is formed as an integral part of said faucet.

6. A water faucet as claimed in claim 1, wherein said nipple is part of a fitting means which is demountably mounted on said faucet.

7. A water faucet as claimed in claim 1 and further comprising:

(a) said nipple having seal retaining means formed on its periphery between the externally threaded portion and the distal end thereof;

(b) seal means mounted in said seal retaining means of said nipple; and (c) said shroud body being configured to provide a smooth surface which circumscribes the axial bore thereof in a location between the closed end of the axial bore and the annular groove of said shroud body with said smooth surface being in sealing engagement with said seal means.

8. A water faucet with demountable swivel spout structure comprising in combination:

(a) a faucet for receiving water from at least one source;

(b) a nipple extending upwardly from said faucet to provide a proximal end and a distal end and having an axial bore for the output of water from said faucet, said nipple having an externally threaded portion intermediate its proximal and distal ends with an annular relief area below the threaded portion; and (c) a swivel spout structure for receiving water from said nipple and directing it to a point of delivery, said swivel spout structure including, I. a shroud body defining an axial bore in which said nipple is coaxially disposed, said shroud body being configured to close the upper end of its axial bore and define an open lower end thereof, said shroud body having internal threads which circumscribe its axial bore adjacent the downwardly open end thereof with said internal threads being coaxially and loosely located in the annular relief area of said nipple, said shroud body further having an annular groove which opens into its axial bore above the internal threads thereof with the external threads of said nipple being coaxially and loosely located in the annular groove of said shroud body, II. a spout extending from said shroud body and defining a water delivery bore which is in water receiving communication with the closed upper end of the axial bore of said shroud body.

9. A water faucet as claimed in claim 8 and further comprising, said shroud body having an axially aligned reduced diameter bore portion at the closed upper end of the axial bore thereof to provide a downwardly facing annular shoulder which is in abutting engagement with the distal end of said nipple.

10. A water faucet as claimed in claim 8 and further comprising:

(a) said nipple having seal retaining means formed in its periphery above the externally threaded portion thereof;

(b) seal means carried in the seal retaining means of said nipple; and (c) said shroud body having a smooth surface which circumscribes its axial bore above the annular groove defined thereby with said smooth surface being in sealing engagement with said seal means.

11. A water faucet as claimed in claim 8, wherein said shroud body and said spout are integrally formed to provide a unitary configuration of said swivel spout structure.

12. A water faucet claimed in claim 8, wherein said nipple is part of a fitting means which is demountably mounted on said faucet.

* * * * *